US006751875B2

(12) United States Patent
Jones

(10) Patent No.: US 6,751,875 B2
(45) Date of Patent: Jun. 22, 2004

(54) HIGH-SPEED, HAND-HELD RECIPROCATING METHOD FOR CUTTING, CARVING, SAWING, CHISELING, FILING, SANDING, AND ENGRAVING

(76) Inventor: William Randolph Jones, 1804 S. Fir Ave., Broken Arrow, OK (US) 74012

( * ) Notice: Subject to any disclaimer, the term of this patent is extended or adjusted under 35 U.S.C. 154(b) by 0 days.

(21) Appl. No.: 10/236,288

(22) Filed: Sep. 6, 2002

(65) Prior Publication Data

US 2003/0047039 A1 Mar. 13, 2003

Related U.S. Application Data

(60) Provisional application No. 60/318,895, filed on Sep. 13, 2001.

(51) Int. Cl.[7] ..... B27B 3/12

(52) U.S. Cl. ..... 30/392; 30/167; 30/329; 81/3.42; 83/698.11; 279/51; 606/85; 451/162

(58) Field of Search ..... 81/3.42, 3.35, 81/489, 177.1; 83/356.2, 698.21, 698.11; 30/329, 167, 392; 279/46.3, 51, 52, 53; 144/35.2; 408/22, 26; 606/85, 171, 177, 84; 451/162

(56) References Cited

U.S. PATENT DOCUMENTS

| | | | | | |
|---|---|---|---|---|---|
| 1,866,529 | A | * | 7/1932 | Farkas | 30/392 |
| 2,984,241 | A | | 5/1961 | Carlson | |
| 3,260,289 | A | * | 7/1966 | Whitten | 30/392 |
| 4,452,316 | A | | 6/1984 | Edwards | |
| 4,644,653 | A | | 2/1987 | Bacon et al. | |
| 4,727,941 | A | | 3/1988 | Fulton | |
| 5,042,592 | A | | 8/1991 | Fisher | |
| 5,513,709 | A | | 5/1996 | Fisher | |
| 5,607,265 | A | | 3/1997 | Lane | |
| 5,676,497 | A | * | 10/1997 | Kim | 408/21 |
| 5,759,093 | A | | 6/1998 | Rodriguez | |
| 5,832,611 | A | | 11/1998 | Schmitz | |
| 6,012,346 | A | * | 1/2000 | Vo | 74/57 |
| 6,048,345 | A | | 4/2000 | Berke | |
| 6,085,850 | A | | 7/2000 | Phillips | |
| 6,119,973 | A | | 9/2000 | Galloway | |
| 6,138,364 | A | | 10/2000 | Schmitz | |
| 6,368,324 | B1 | * | 4/2002 | Dinger et al. | 606/85 |

* cited by examiner

*Primary Examiner*—Allan N. Shoap
*Assistant Examiner*—Phong Nguyen

(57) ABSTRACT

A high-speed, hand-held attachment for flex rotor shafts of power rotary tools, and also for direct attachment to power rotary tools without flex rotor shafts, that converts rotary motion to reciprocating motion for precision control of cutting, carving, sawing, chiseling, filing, sanding, and engraving on delicate work pieces. The attachment is one assembly comprising a one-piece front one-piece enclosure (20), a rear one-piece enclosure (30), a high-speed bearing (22), a one-piece rotating piece (40) with integral cam groove, a one-piece reciprocating piece (50) with an integral cam follower on one end and with its other, exposed end accomodating the attachment of a chuck or collet and with geometry to prevent rotation, and a thumbscrew (32). Rotating piece (40) attaches directly to the rotary power source and provides the cam action drive to reciprocating piece (50). Bearing (22) provides rotative support for the other end of rotating piece (40). Reciprocating piece (50) slidably mounts in front one-piece enclosure (20). Front one-piece enclosure (20) and rear one-piece enclosure (30) are attached to each other and maintain proper alignment for rotating piece (40), bearing (22), and reciprocating piece (50). Thumbscrew (32) secures the attachment to the flex rotor shaft of a power rotary tool. A tool holder/collet is attached to the exposed end of reciprocating piece (50) whereby numerous types of cutting tools may be utilized. Alternative versions of the rear one-piece enclosure, (30A) and (30B), described herein, allow for attachment directly to power rotary tools without flex rotor shafts. Alternative versions of the reciprocating piece, (50A), (50B), and (50C), and of the rotating piece, (40A), are also described herein.

12 Claims, 16 Drawing Sheets

(NUMEROUS OTHER COMBINATIONS ARE POSSIBLE)

HIGH-SPEED, HAND-HELD RECIPROCATING METHOD FOR CUTTING, CARVING, SAWING, CHISELING, FILING, SANDING, AND ENGRAVING

CROSS-REFERENCE TO RELATED APPLICATIONS

This application is entitled to the benefit of Provisional Patent Application No. 60/318,895, filed Sep. 13, 2001.

BACKGROUND

1. Field of Invention

This present invention relates to hand-held tools, specifically to a hand-held reciprocating attachment for power rotary tools.

2. Discussion of Prior Art

Power-driven hand-held rotary tools and reciprocating tools are known to exist in prior art. Such tools currently available exhibit problems in regards to delicate, detail work.

Rotary tools rotate tool attachments, such as ball grinders, sanding discs and drums, and cutting wheels, at a variable RPM up to very high RPM. Although such rotary tools are very useful in numerous applications they do have limitations. When trying to perform detailed shaping or precise removal of material from a work piece with a hand-held rotating tool, a ball grinder, sanding disc or drum, or cutting wheel attachment can grab a material and cause a tool to be pulled in an unwanted direction thereby blemishing or even destroying a work piece. For one example of a professional application, this potentially damaging scenario is a real concern when modifying or repairing very expensive electronic printed circuit board assemblies. It is common practice to use either a manual razor knife or a rotary tool with a small cutting ball to sever small clad runs on electronic printed circuit boards where a connection needs to be broken. When the operator loses control of a rotary cutting tool due to grabbing numerous unwanted clad traces can be severed, sometimes in an un-repairable area of the board, resulting in hundreds or thousands of dollars in wasted inventory. Also, using a manual hobby razor knife in such as application requires quite a bit of force that can promote slipping and loss of control. Cutting with a rotary tool is limited to the use of a spinning, abrasive cutting wheel, and gaining access to a desired area of a work piece at a desired cutting angle is sometimes impossible to achieve. This is because rotary cutting tools have a limitation in that some of the parts comprising the drive mechanism of the cutting wheel are either above, below, to the right, or to the left of the plane of the cutting wheel depending on orientation. Carving with a hand-held rotary tool requires the use of a spinning, course-cutting attachment that, too, can catch on a material, cause a tool to be pulled in an unwanted direction, and cause damage to a work piece. Sawing with a hand-held rotary tool is limited to the use of a spinning, abrasive cutting wheel, or a round saw with teeth, and gaining access to a desired area of a work piece at a desired cutting angle is sometimes impossible to achieve. Also, the depth of cut realized with a cutting wheel or round saw is limited to slightly less than its radius. Chiseling with a hand-held rotary tool using only rotating motion is potentially dangerous because it requires a rotating bit containing cutting blades that is difficult to control and certainly not suited for fine, detail work. Filing with a hand-held rotary tool is limited to a use of a spinning, abrasive cutting wheel or a spinning abrasive bit. Gaining access to a desired area of a work piece at a desired angle with an abrasive wheel for filing is sometimes impossible to achieve, and filing with a spinning abrasive bit can cause unwanted variable-depth cuts, or unwanted grooves, in a work surface. Sanding with a hand-held rotary tool requires a spinning sanding disc or a sanding drum attachment that can grab a material, cause a tool to be pulled in an unwanted direction, and either cause damage to or destroy a work piece.

Some available hand-held reciprocating tools are too large and too heavy to hold properly for extreme detail work because they include an AC motor or a DC motor with batteries. Also, they are more dedicated to certain applications, such as just sanding or just carving, and don't allow for an assortment of tool attachment types. Some do not hold tool attachments firmly enough for extremely fine control of a tool attachment.

Reciprocating carving tools that don't activate until the cutting edge is pressed against the work piece with a force parallel to the longitudinal axis are not suited for knife blades, saw blades, files, and sanders because such tool attachments require pressure to be applied perpendicular to the tool's longitudinal axis. Therefore, force-activated tools are typically limited to chisels and gouges and are not suited for delicate work because the required force to active may exceed the mechanical strength of the work piece.

Hammer-type reciprocating tools impart a potentially damaging impulse to delicate work pieces. Also, the impact and spring return mechanisms do not have a high frequency response. They do not allow for a fine degree of force control required for delicate work pieces.

Engravers are reciprocating tools, but they are limited in their ability to provide a variable-speed, variable-length stroke. They also are not suited for the use of other types of cutting tools and are dedicated to engraving only.

A reciprocating hand tool for flexible shafts in U.S. Pat. No. 1,866,529 to Farkas, is provided for general reference. The referenced inclined annular groove will result in large acceleration and deceleration forces between the annular groove and the ball and socket set screw.

A solenoid-powered surgical osteotome in U.S. Pat. No. 2,984,241 to Carlson, is in a different technical field as compared to the invention claimed in this application.

A saber saw attachment in U.S. Pat. No. 3,260,289 to Whitten, claims a saber saw attachment, to the exclusion of other types of cutting tools.

A reciprocating chisel blade power hoe in U.S. Pat. No. 4,452,316 to Edwards, is in a different technical field as compared to the invention claimed in this application.

A reciprocating knife in U.S. Pat. No. 4,644,653 to Bacon, Feb. 24, 1987, claimed a reciprocating knife tool, to the exclusion of other types of tools. Additionally, the invention claimed the use of two opposed elastic members for biasing, which has a limited frequency response, and screws to affix a cutting blade section to a blade, which can loosen due to vibration and which require additional tools for assembly.

A power operated reciprocating hand tool in U.S. Pat. No. 4,727,941 to Fulton, Feb. 24, 1986, claimed a flexible sleeve and utilized a flexible reciprocating cable, coil spring, and mallot that applied a fixed impact force to a cutting tool that limits its applications. Furthermore, a spring's response limited the attainable reciprocating frequency.

A power tool in U.S. Pat. No. 5,042,592 to Fisher, Aug. 27, 1991, was designed for heavier-duty home project applications such as paint scraper and a wallpaper stripper, as opposed to highly detailed and/or more delicate applications, and claims a sinusoidal cam track and cam follower mechanism with a pair of struts, and intermediate gearing interposed between the drive mechanism and the output shaft. Furthermore, this is in a different technical field as compared to the invention claimed in this application.

A power tool in U.S. Pat. No. 5,513,709 to Fisher, May 7, 1996, was designed for heavier-duty home project applications such as paint scraper and a power spade, as opposed to highly detailed and/or more delicate applications, and claims a sinusoidal cam track and cam follower mechanism with at least two studs, struts, or bosses, and intermediate gearing interposed between the drive mechanism and the output shaft. Furthermore, this is in a different technical field as compared to the invention claimed in this application The reciprocating attachment for hand drills in U.S. Pat. No. 5,607,265 to Lane, Mar. 4, 1997, is designed to work only with saw blades while being powered by a lower-RPM hand drill. Furthermore, the saw blade is attached with screws that are subject to loosening under vibration and the saw blade mounting method requires that either special, non-standard saw blades be purchased by the consumer or requires that the consumer modify existing saw blades for adequate mounting.

The power drill-saw with simultaneous rotation and reciprocation action in U.S. Pat. No. 5,676,497 to Kim, Oct. 14, 1997, claims a cam key and a cam groove with an elliptical orbit about a cam cylinder. The elliptical orbit will result in large acceleration and deceleration forces between the cam groove and the cam key resulting in excessive wear.

The electric oscillating abrasive file in U.S. Pat. No. 5,759,093 to Rodriguez, Jun. 2, 1998, claimed an electric abrasive file, to the exclusion of other types of tools, and included a U-shaped spring clip to hold a file tool that had limited resistance to applied forces.

A variable angle reciprocating tool in U.S. Pat. No. 5,832,611 to Schmitz, Nov. 10, 1998, claimed a motor housing and motor and is bulky and heavy, which is a negative in regards to fine detail work.

A low vibration motion translation system in U.S. Pat. No. 6,012,346 to Vo, Jan. 11, 2000, claims a low vibration motion translation system but it neither provides a detailed solution for affixing an outside housing, which would thereby make a hand-held device for an end user, nor does it provide detailed solutions for easily affixing various tools to the reciprocating piece.

A motorized reciprocating surgical file apparatus and method in U.S. Pat. No. 6,048,345 to Berke, Apr. 11, 2000, is in a different technical field as compared to the invention claimed in this application.

A miniature impact tool in U.S. Pat. No. 6,085,850 to Phillips, Jul. 11, 2000, is primarily used to impact a cutting tool (chisel) against a work piece. It utilizes a spring in its design and therefore its frequency response is limited. Furthermore, its hammer-type action could impart a potentially damaging impulse to delicate work pieces A reciprocating apparatus and cam follower for winding a package in U.S. Pat. No. 6,119,973 to Galloway, Sep. 19, 2000, is in a different technical field as compared to the invention claimed in this application. Furthermore, a reciprocating apparatus and cam follower for winding a package claimed a strand guide intended for glass strands.

A variable angle reciprocating tool in U.S. Pat. No. 6,138,364 to Schmitz, Oct. 31, 2000, employed multiple gears and multiple bearings which make the assembly more complex and therefore more prone to mechanical problems.

Powered surgical handpiece assemblies and handpiece adapter assemblies in U.S. Pat. No. 6,368,324 B1 to Dinger et al, Apr. 9, 2002, is in a different technical field as compared to the invention claimed in this application. Furthermore, front housing and rear housing are multiplied piece assemblies as opposed to much simplified one-piece front enclosure and one-piece rear enclosure of the invention claimed in this application. Also, the suction tube is not required for the invention claimed in this application.

No prior art directly germane to this invention was found which anticipates the inventive combination disclosed below. Furthermore, I am very familiar with both the hobby industry and the tool industry and have never seen anything like my hand-held, reciprocating attachment promoted for sale.

SUMMARY

A high-speed, hand-held reciprocating method for cutting, carving, sawing, chiseling, filing, sanding, and engraving of the subject invention provides for greatly improved ease in cutting, carving, sawing, chiseling, filing, sanding, and engraving in a multitude of applications. My hand-held, reciprocating attachment allows for more delicate control of a desired operation by reducing the amount of required force applied to a work piece while reciprocating a cutting tool at a high-frequency to minimize the process time. By reducing the required amount of force applied to a work piece, safety of a user is enhanced, fine control over material removal is enhanced, and the chance of damage to a work piece is reduced. A preferred embodiment is described herein but in no way is intended to limit the design details of the subject invention. Applications include, but are not limited to, odd jobs, home repair jobs, arts and crafts, hobby projects, sculpture, electronic printed-circuit board rework, mat cutting for picture frames, and professional model building.

OBJECTS AND ADVANTAGES

Accordingly, several objects and advantages of my hand-held, reciprocating attachment are that it is compact and easy to hold and manipulate in your hand and fingertips for very precise work. It is held in one's hand more like a small hobby knife rather than like a more bulky power tool and is therefore very comfortable to use. It is capable of accepting a wide assortment of flat and round cutting tools such as knife blades, saw blades, carving blades, chisels, gouges, round and flat files, and sanding paddles. As an attachment, it converts popular, commercially available, variable-speed rotor tools into even more versatile variable-speed reciprocating tools. One example of such a rotor tool is a DREMEL® tool and optional flex rotor shaft, manufactured by, and a registered trademark of, DREMEL of Racine, Wisc., which is the subject of the preferred embodiment. My hand-held reciprocating attachment can be altered to conform to other rotor tools. Installation onto an end of a rotating flex cable drive source is quick and easy. No assembly tools are required to assemble my hand-held reciprocating attachment nor to install it onto a flex cable nor to install any of a plurality of cutting tools. It is very user-friendly and allows a user to make quick changes in cutting tools. My hand-held, reciprocating attachment is capable of running at very high reciprocating frequencies, being limited mainly by the rotating drive source. Loss of control of a spinning rotary cutting tool, and subsequent damage to the work piece, is eliminated with this current invention.

Rotary cutting wheels and rotary saw blades have a limitation in that the depth of any cut cannot exceed their radius due to the interfering axial drive. Unlike rotary cutting wheels and rotary saw blades that have parts above or below the plane of the wheel, my hand-held, reciprocating attachment, with its reciprocating cutting tool being on the assembly's extremity with no interfering pieces, allows deep, perpendicular cuts, as well as cuts at any angle, in cramped spaces.

My hand-held, reciprocating attachment is also capable of being used as an engraver. By installing the proper hardened point tool the variable-speed, variable-stroke reciprocating attachment accommodates finely controlled engraving.

My hand-held, reciprocating attachment is comprising of a minimum of pieces. Accordingly, my hand-held, reciprocating attachment is very reliable. My hand-held, reciprocating attachment eliminates the need for gears, springs, elastic members, and clips, thereby saving cost and complexity and improving overall reliability. Not using springs in my hand-held reciprocating attachment allows for improved frequency response at the higher reciprocating frequencies. No use of gears allows for improved wear by eliminating more wear surfaces and minimizing potential mechanical problems. Using tool holder/collets instead of clips results in improved, more positive holding force for the cutting tools and accommodates both flat and round cutting tools allowing a wide array of tool selection.

Other objects and advantages are illustrated as follows. Using razor knives, wood carving blades, saw blades, gouges, chisels, files and sanding paddles mounted in handles for holding in one's hand without the aid of mechanical power, in other words, manual tools, is very common in both professional and hobby-related model building, all types of arts and crafts, and in all types of odd-jobs. The need to place excessive pressure on a cutting edge for some applications is dangerous and can injure a user if the cutting edge slips, and can also be damaging to the work piece. Also excessive pressure on a cutting edge can reduce accuracy. Also, numerous strokes are quite often required, at the expense of time and energy, to cut through material or to remove a desired amount of material. This leads to user fatigue and loss of accuracy. The lesser the amount of force that is used in the operation, in the interest of improving safety and minimizing damage, the greater the number of strokes that are required to achieve the desired results. A greater number of strokes, again, leads to user fatigue and loss of accuracy.

My high-speed, hand-held reciprocating method for cutting, carving, sawing, chiseling, filing, sanding, and engraving of the subject invention imparts a very high-speed reciprocating motion to a cutting or carving blade, gouge, saw, chisel, file or sanding device. This in turn allows a user to apply a cutting edge accurately while using significantly reduced force thereby greatly reducing fatigue, improving delicate control, and reducing the chance of damage or injury to both the user and the work piece. A reduced force applied to the cutting tool, compensated for by a variable speed, up to a very high-speed, reciprocating motion, in concert with a very short but variable-length stroke, provides exceptional results.

My hand-held, reciprocating attachment is not a force-activated device and therefore accommodates a multiplicity of reciprocating cutting tools, not just chisel-like cutting tools. Since it is not a force-activated device, my hand-held, reciprocating attachment is very useful for delicate and highly detailed work because a force does not need to be applied before the cutting action starts. Since, my hand-held, reciprocating attachment does not require force-activation, it will function even with feather-light applied forces and will therefore not overwhelm delicate work pieces.

Variations of my hand-held, reciprocating attachment will allow attachment directly to a power rotary tool instead of to a flex rotor shaft for users so inclined.

Further objects and advantages of my hand-held, reciprocating attachment will become apparent from a consideration of the drawings and ensuing description.

DRAWING FIGURES

Figure 1:
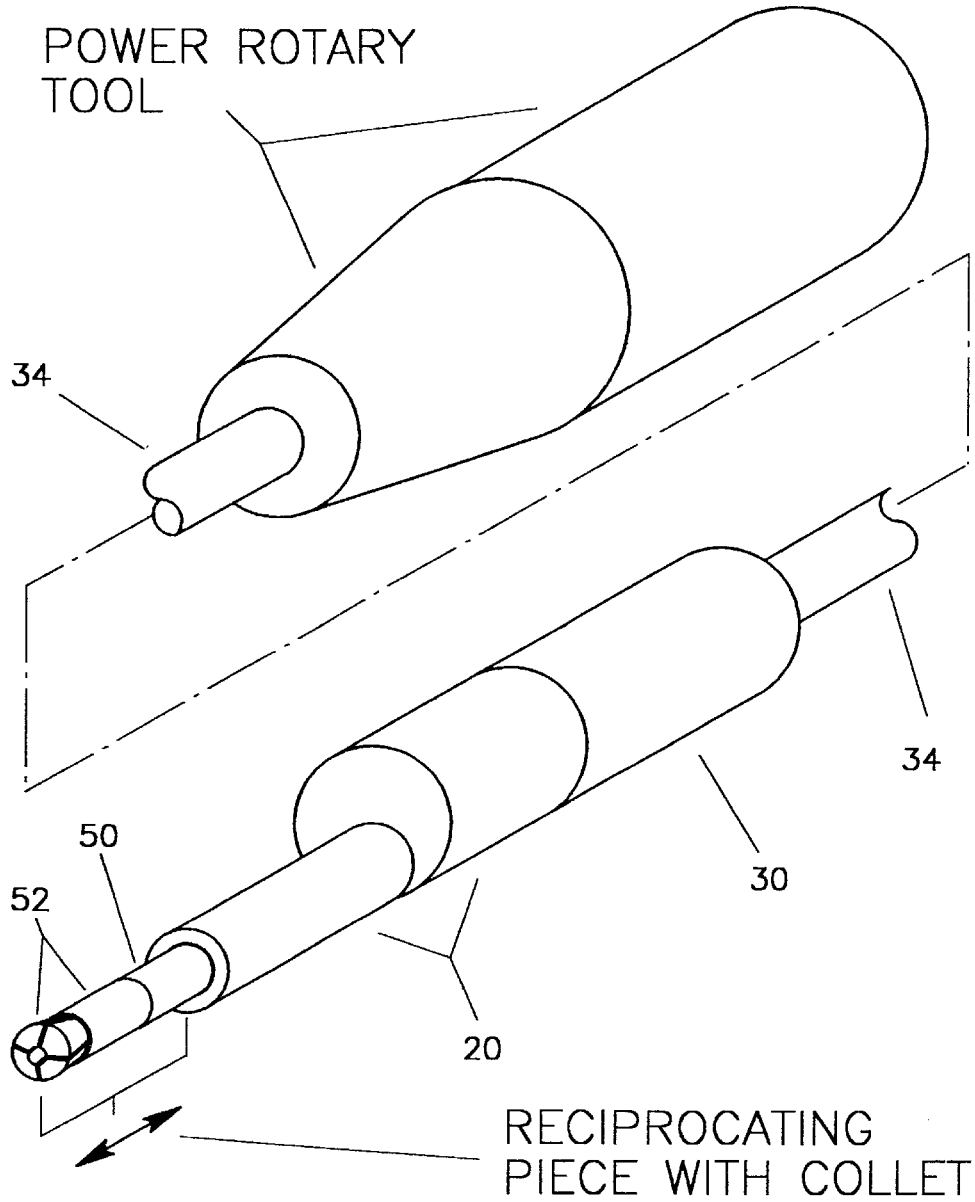
FIG. 1 shows a perspective view with flex rotor shaft and power rotary tool

| Reference Numerals in Drawings | |
|---|---|
| 20 | front one-piece enclosure |
| 22 | cylindrical single row radial bearing |
| 30 | rear one-piece enclosure for attachment to flex rotor shaft |
| 30A | alternative rear one-piece enclosure for direct attachment to a power rotary tool |
| 30B | alternative rear one-piece enclosure for direct attachment to a different style of power rotary tool |
| 32 | thumbscrew |
| 34 | flex rotor shaft |
| 40 | rotating piece with female threads |
| 40A | rotating piece with shaft |
| 50 | reciprocating piece terminated with female threads |
| 50A | alternative reciprocating piece terminated with male threads |
| 50B | alternative reciprocating piece terminated with integral one-piece collet |
| 50C | alternative reciprocating piece terminated with larger female threads |
| 52 | tool holder/collet |
| 54A | cutting blade examples |
| 54B | carving blade examples |
| 54C | gouge examples |
| 54D | saw blade examples |
| 54E | chisel examples |
| 54F | file examples |
| 54G | sanding device examples |
| 54H | engraver example |

DESCRIPTION OF INVENTION—PREFERRED EMBODIMENT

Figure 2:
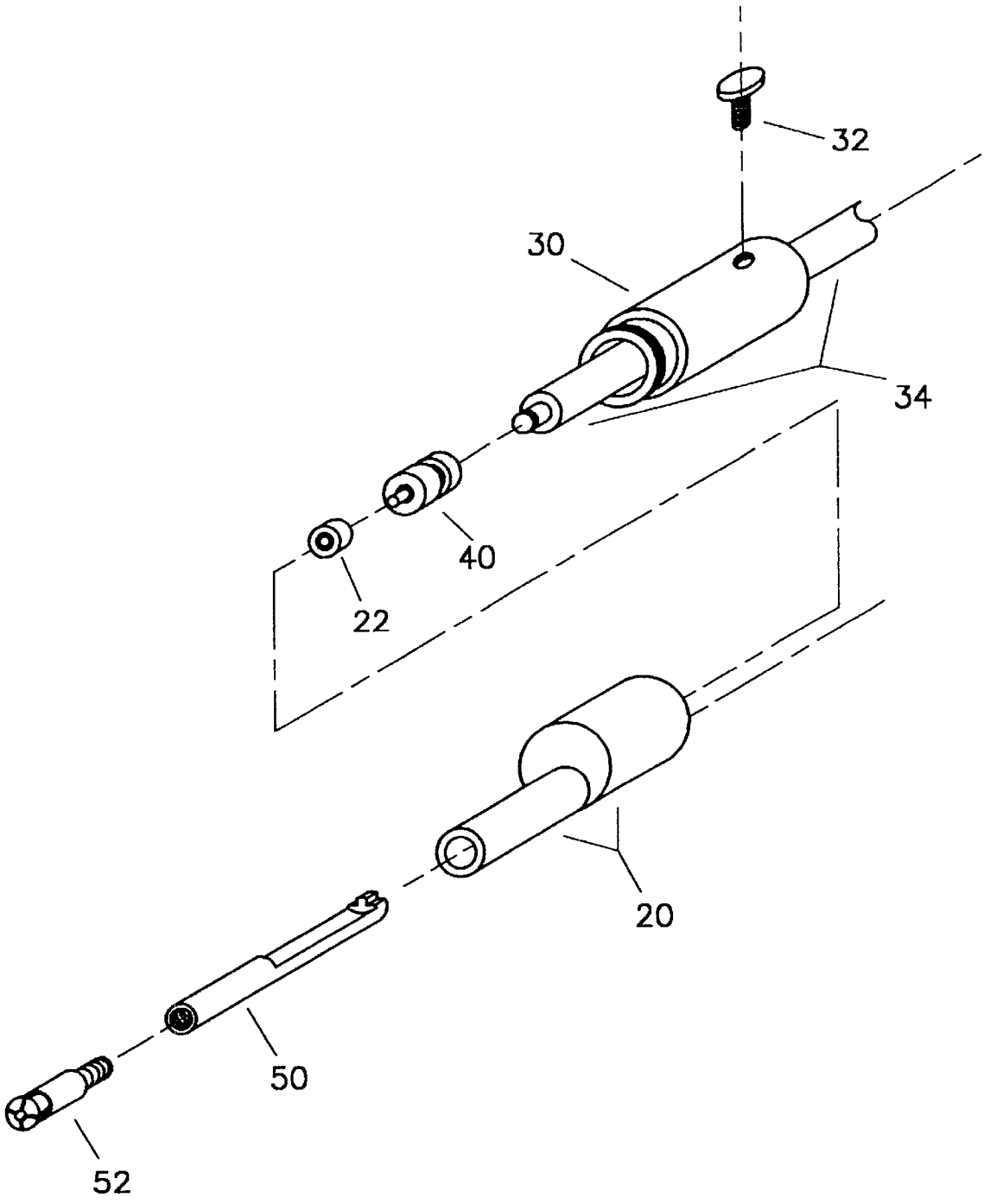
FIG. 2 shows an exploded view
Figures 3A, 3B:
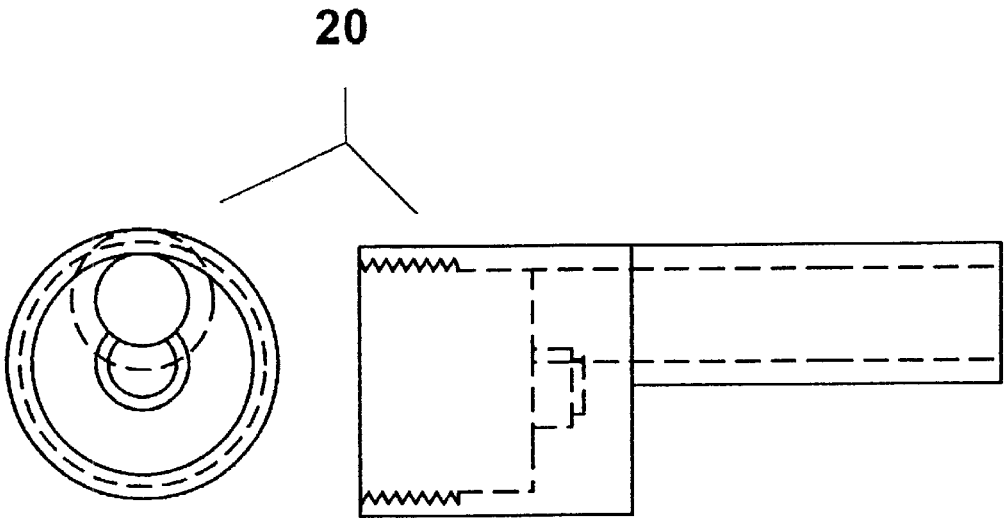
FIG. 3A shows an end view of a one-piece enclosure
FIG. 3B shows a side view of a one-piece enclosure
Figures 4A, 4B:
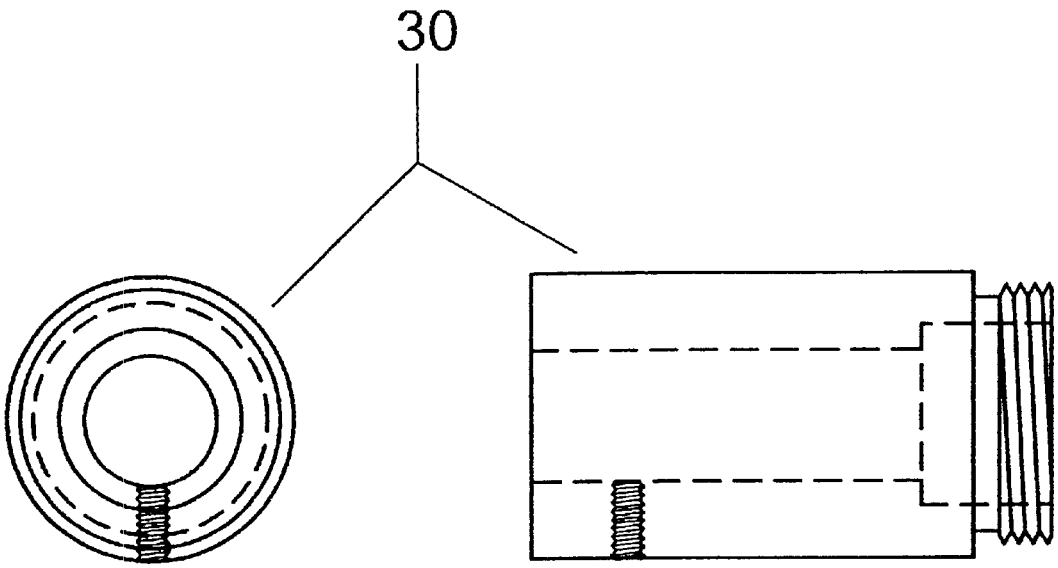
FIG. 4A shows an end view of a rear one-piece enclosure
FIG. 4B shows a side view of a rear one-piece enclosure
Figures 5A, 5B:
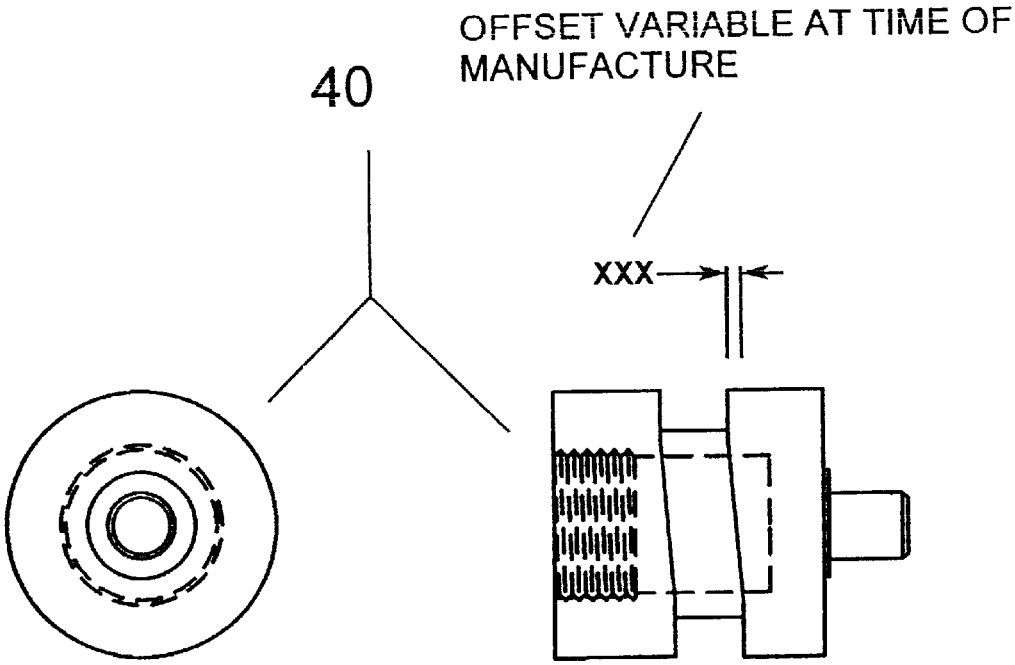
FIG. 5A shows an end view of a rotating piece
FIG. 5B shows a side view of a rotating piece
Figures 6A, 6B:
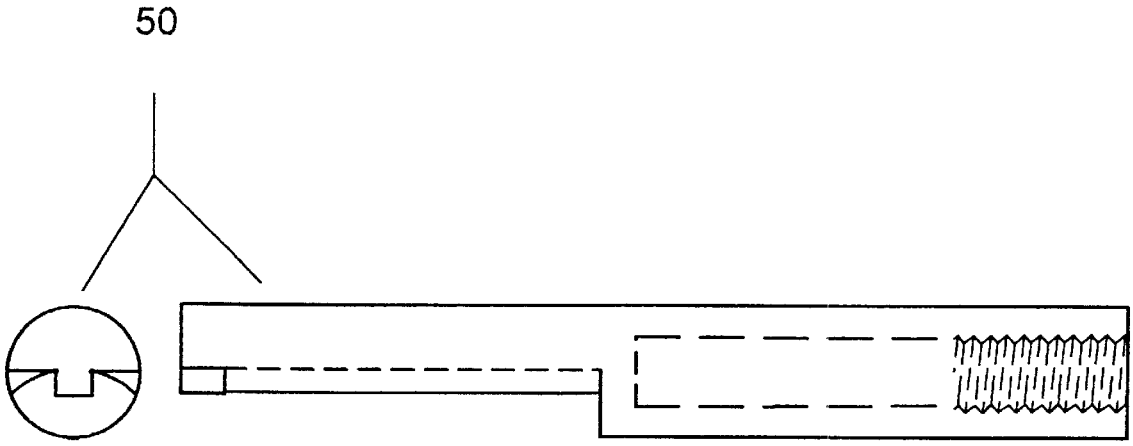
FIG. 6A shows an end view of a reciprocating piece
FIG. 6B shows a side view of a reciprocating piece
Figure 12A:
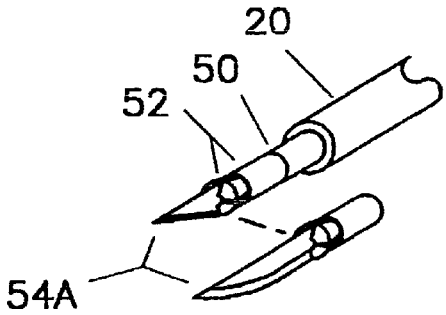
FIG. 12A shows examples of cutting blades
Figure 12B:
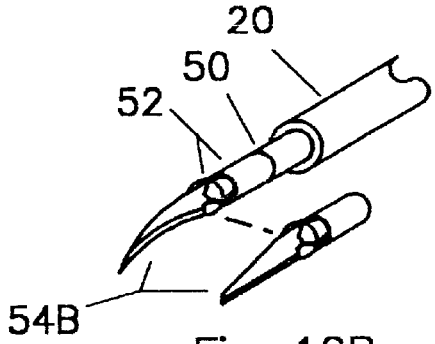
FIG. 12B shows examples of carving blades
Figure 12D:
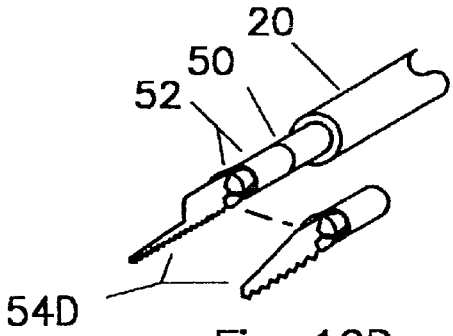
FIG. 12D shows examples of saw blades
Figure 12C:
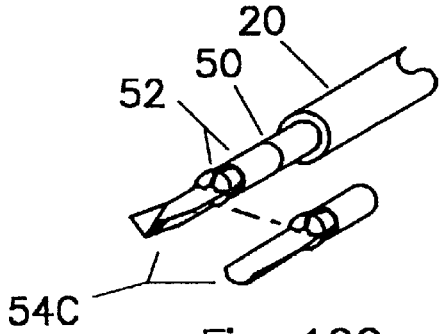
FIG. 12C shows examples of gouges
Figure 12E:
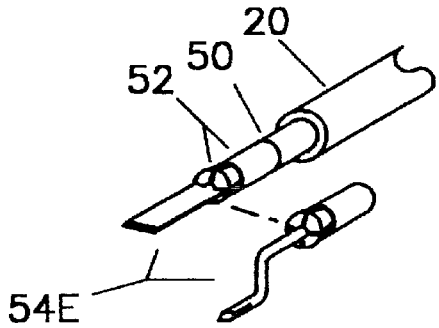
FIG. 12E shows examples of chisels
Figure 12F:
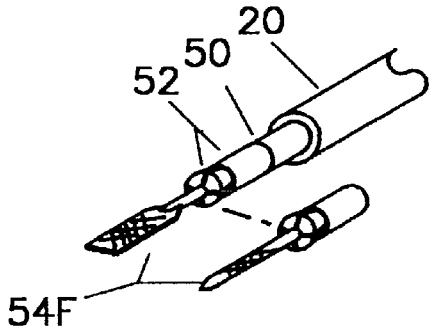
FIG. 12F shows examples of files
Figure 12G:
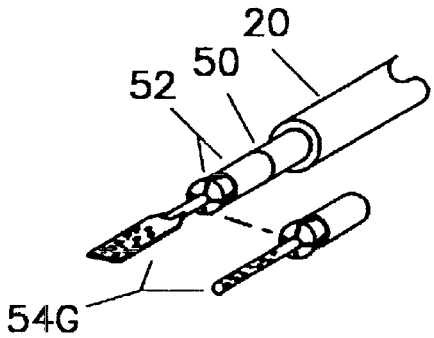
FIG. 12G shows examples of sanding devices
Figure 12H:
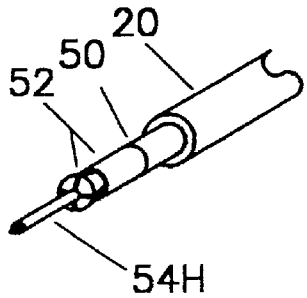
FIG. 12H shows example of an engraver

A high-speed, hand-held reciprocating method for cutting, carving, sawing, chiseling, filing, sanding, and engraving of the subject invention provides for greatly improved ease in cutting, carving, sawing, chiseling, filing, sanding, and engraving in a multitude of applications. A preferred embodiment is described herein but in no way is intended to limit design details, size, materials, finish, or methods of manufacturing, of the subject invention. FIG. 1 shows a perspective of the preferred embodiment. FIG. 2 shows an exploded view of the preferred embodiment. My hand-held, reciprocating attachment comprises one assembly that includes a machined, front one-piece enclosure 20, FIG. 3A and FIG. 3B, a machined, one-piece rear one-piece enclosure 30, FIG. 4A and FIG. 4B, a machined, one-piece rotatively driven rotating piece 40 with an integral cam groove, FIG. 5A and FIG. 5B, a machined, one-piece reciprocating piece 50 with an integral cam follower and an attachment point for a tool holder or collet, FIG. 6A and FIG. 6B, a commercially obtained bearing 22, FIG. 2, a commercially obtained tool holder or collet 52 for a plurality of cutting blades, a plurality of carving blades, a plurality of gouges, a plurality of saw blades, a plurality of chisels, a plurality of filing devices, and a plurality of sanding devices, FIG. 2, a commercially obtained thumbscrew 32, FIG. 2, and commercially obtained cutting blades 54A, FIG. 12A, carving blades 54B, FIG. 12B, gouges 54C, FIG. 12C, saw blades 54D, FIG. 12D, chisels 54E, FIG. 12E, files 54F, FIG. 12F, sanding devices 54G, FIG. 12G, and an engraving device 54H, FIG. 12H. Items 54A through 54H are examples only and do not represent all of the possible combinations. Front one-piece enclosure 20 and rear one-piece enclosure 30 are made to mate together to enclose and accurately hold rotating piece 40, bearing 22, and reciprocating piece 50 in their proper, respective positions relative to each other while allowing adequate freedom of movement of the respective internal pieces. Front one-piece enclosure 20 and rear one-piece enclosure 30 are sized to promote comfort of holding and gripping my hand-held, reciprocating attachment comfortably in one's hand for use. A preferred embodiment of front one-piece enclosure 20 includes a knurled area around its minor circumference, the barrel-like portion, to promote a more secure and safer grip by an operator's fingers while allowing the assembly to rest over the top of the operator's hand. A preferred embodiment of rear one-piece enclosure 30 includes a knurled area around its circumference to facilitate tightening during assembly to or loosening during disassembly from front one-piece enclosure 20. Rotating piece 40 is rotatively driven via mechanical connection of one end to an externally supplied, commercially available flex rotor shaft 34. Another end of rotating piece 40 is supported by high-speed bearing 22 mounted inside front one-piece enclosure 20. Reciprocating piece 50 is held in place adjacent to rotating piece 40 by front one-piece enclosure 20 such that the cam follower portion of reciprocating piece 50 rests inside the cam groove of rotating piece 40. As rotating piece 40 is rotatively driven reciprocating piece 50 is allowed to freely translate along its longitudinal axis via cam action through a maximum distance determined by the particular rotating piece 40 installed at that time. In a preferred embodiment cross-sectional diameters of reciprocating piece 50 and rotating piece 40 overlap. However, a portion of reciprocating piece 50 on the same side as the cam follower of reciprocating piece 50 in aposition to rotating piece 40 is relieved just enough to provide clearance from the main body of rotating piece 40 and the relief is curved around a portion of the main body of rotating piece 40 so as to prevent rotation of reciprocating piece 50 which, in turn, prevents disengagement of the cam follower on reciprocating piece 50 from the cam groove on rotating piece 40. A cam groove offset of rotating piece 40 is variable from piece to piece at time of manufacture to suit a particular application. Rear one-piece enclosure 30 encloses one end of an externally supplied flex rotor shaft 34. Rear one-piece enclosure 30 allows for installation of thumbscrew 32 through its side to firmly captivate it in relation to an externally supplied flex rotor shaft 34. With all pieces in place, after rear one-piece enclosure 30 and front one-piece enclosure 20 have been properly mated, the assembly is firmly captivated to an end of flex rotor shaft 34 using thumbscrew 32. An opposite end, the outside end, of reciprocating piece 50 extends past the smaller-diameter end of front one-piece enclosure 20 even at its rearmost point of travel. In a preferred embodiment the outside end of reciprocating piece 50 is threaded to accept a commercially available tool holder or collet 52 for cutting blades, carving blades, gouges, saw blades, chisels, files, and sanding devices. Rear one-piece enclosure 30 encloses a portion of a handgrip on the end of an externally supplied flex rotor shaft 34. Rear one-piece enclosure 30 allows for installation of thumbscrew 32 through its side. With all pieces in place, after rear one-piece enclosure 30 and front one-piece enclosure 20 have been properly mated, an assembly of the subject invention is firmly captivated to the end of flex shaft 34 using thumbscrew 32.

OPERATION OF INVENTION

Figure 7A:
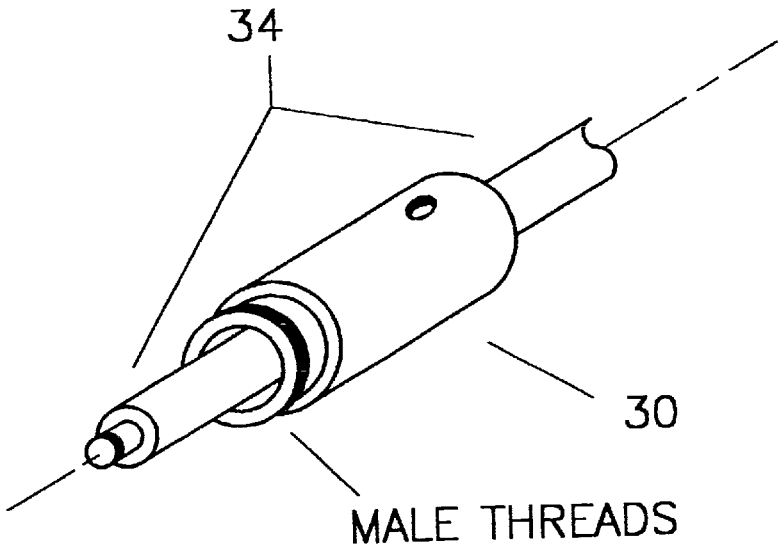
FIG. 7A shows a rear one-piece enclosure and flex rotor shaft installation view
Figure 7B:
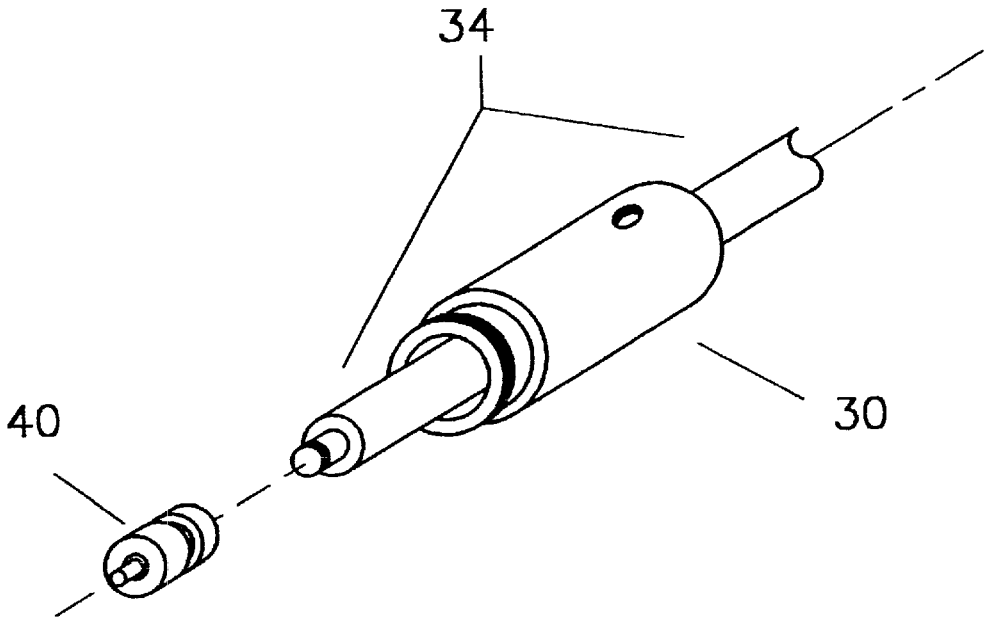
FIG. 7B shows a rotating piece and flex rotor shaft installation view
Figure 8:
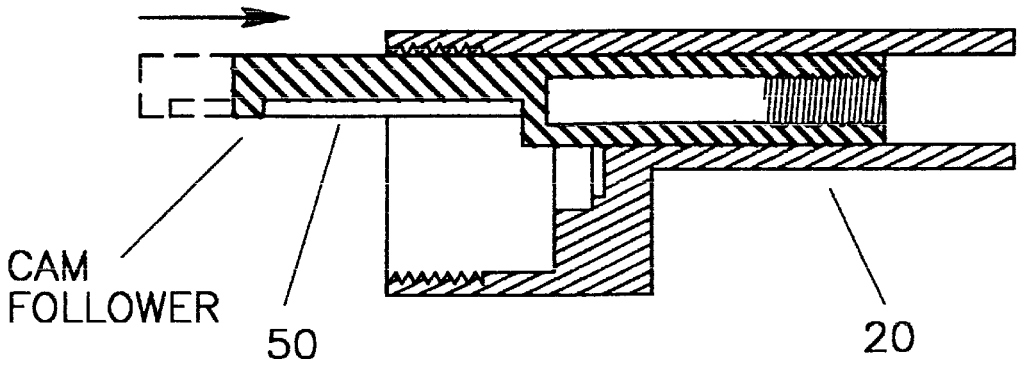
FIG. 8 shows a bearing installation view
Figure 9:
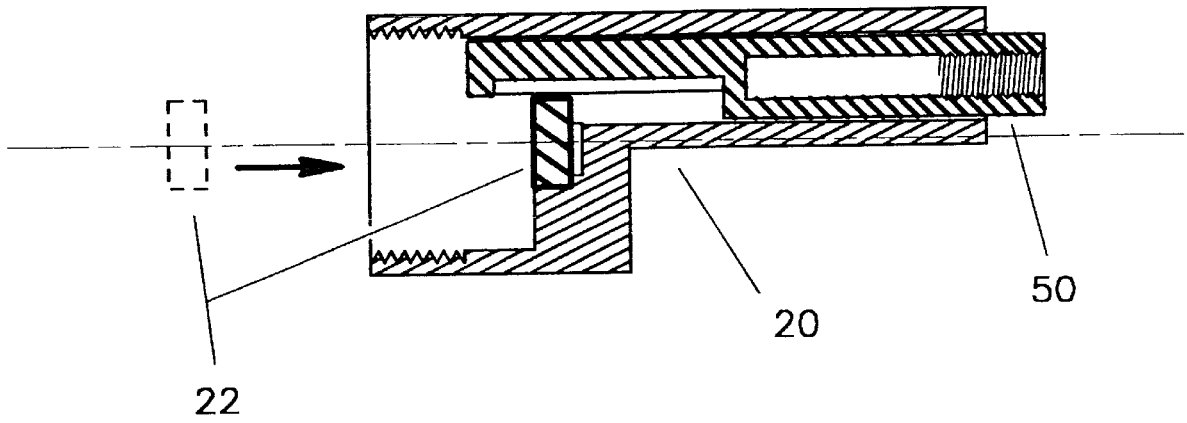
FIG. 9 shows a reciprocating piece installation view
Figure 10A:
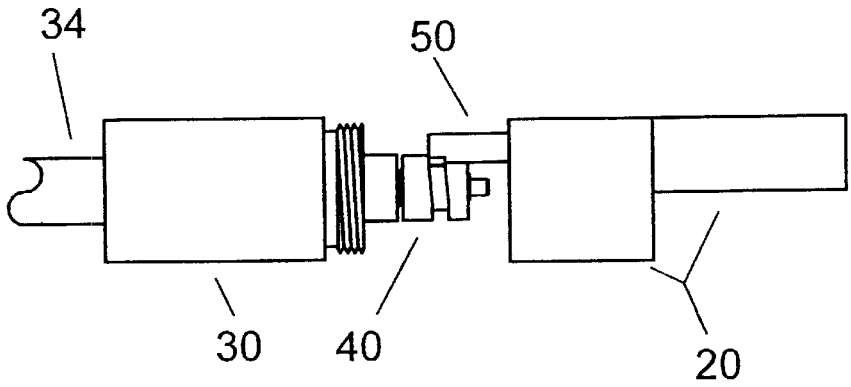
FIG. 10A shows engagement of cam and cam follower
Figure 10B:
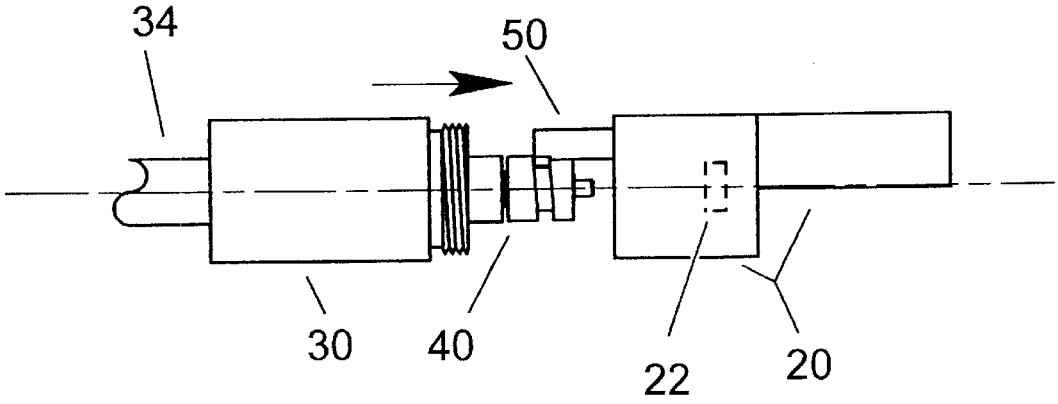
FIG. 10B shows engagement of rotating piece and cylindrical single row radial bearing
Figure 11A:
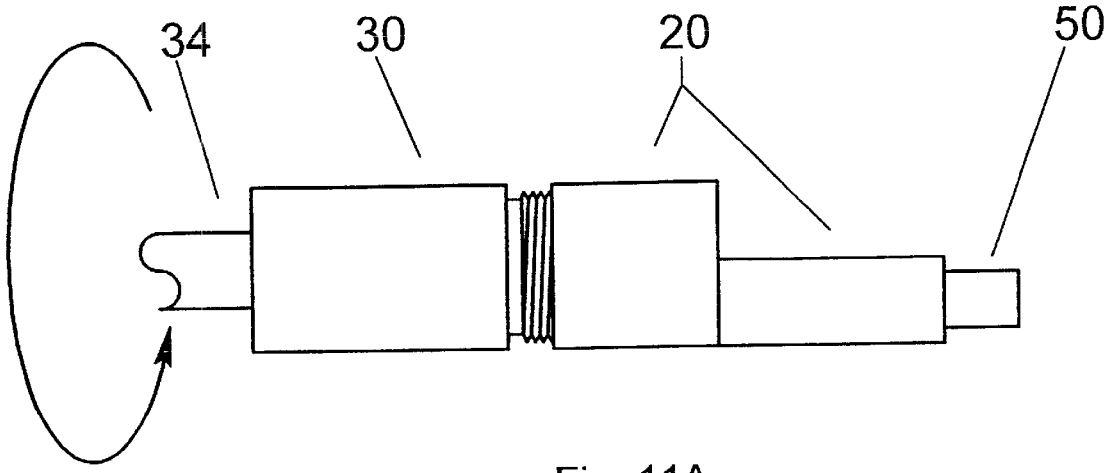
FIG. 11A shows engagement of rear one-piece enclosure and front one-piece enclosure
Figure 11B:
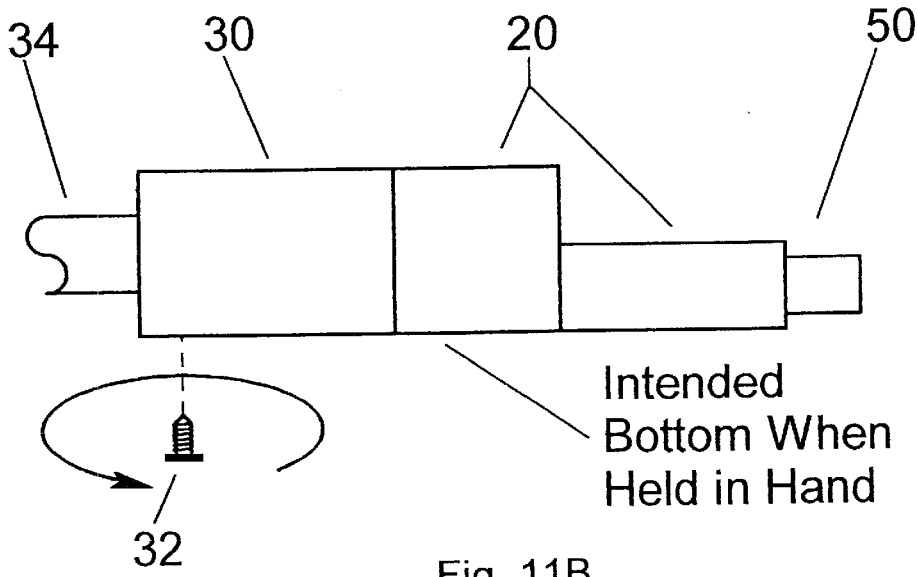
FIG. 11B shows securing the assembly with a thumbscrew

The description contained herein is based on the preferred embodiment and assumes that no pieces of the assembly have previously been connected to each other. To prepare the high-speed, hand-held reciprocating attachment for use it must be assembled onto an externally provided, commercially available flex rotor shaft of a DREMEL® rotor tool. Referring to FIG. 7A, one first slips rear one-piece enclosure 30 over the end of the externally supplied flex rotor shaft 34 of the commercially available rotor tool, not shown, making sure that rear one-piece enclosure 30 is oriented such that the large, male threads of rear one-piece enclosure 30 are placed over the end of the flex rotor shaft last. Next, referring to FIG. 7B, rotating piece 40 is attached to the externally supplied flex rotor shaft 34 of the commercially available flex rotor tool, not shown, by threading rotating piece 40, having female threads, onto flex rotor shaft 34, having male threads. Next, as illustrated in FIG. 8, reciprocating piece 50 is partially inserted into front one-piece enclosure 20, oriented such that the female-threaded end of reciprocating piece 50 is in the barrel-like portion of front one-piece enclosure 20 and leaving the other, cam-follower end of reciprocating piece 50 extending out past the large end of front one-piece enclosure 20 with the cam follower pointing toward the central axis of front one-piece enclosure 20. Next, referring to FIG. 9, bearing 22 is installed into front one-piece enclosure 20. Next, referring to FIG. 10A and FIG. 10B, while holding front one-piece enclosure 20 in one hand and flex rotor shaft 34 in the other hand, place the cam follower of reciprocating piece 50 into the cam groove of rotating piece 40. While keeping the cam follower and cam groove engaged, slide front one-piece enclosure 20 toward rotating piece 40 until the coaxial shaft of rotating piece 40 fully engages the center hole of bearing 22. Next, referring to FIG. 11A and FIG. 11B, slide rear one-piece enclosure 30 towards front one-piece enclosure 20, engage and finger tighten the large threads, and then install thumbscrew 32 into rear one-piece enclosure 30 and tighten against flex rotor shaft 34. The reciprocating adapter is now installed and is ready to accept a tool holder/collet and any desired cutting tool.

Disassemble in the reverse order described above except that bearing 22 can be left in place in front one-piece enclosure 20 indefinitely.

Front one-piece enclosure 20 functions as a slidable enclosure for reciprocating piece 50. Front one-piece enclosure 20 functions as an enclosure and a retainer for bearing 22. Front one-piece enclosure 20 functions as a partial enclosure for rotating piece 40. Front one-piece enclosure 20 includes female threads inside its major diameter to mate with the male threads of rear one-piece enclosure 30. Front one-piece enclosure 20 is shaped to accommodate holding my hand-held, reciprocating attachment in much the same way as one would hold a standard hobby knife, a pencil, or an air brush. A preferred embodiment of front one-piece enclosure 20 includes a knurled area around its minor circumference, the barrel-like portion, to promote a more secure and safer grip by an operator's fingers while allowing the assembly to rest over the top of the operator's hand in much the same way as one would hold an air brush. For tool attachments such as carving gouges and chisels the front one-piece enclosure can be grasped by cupping one's hand over the top and grasping the knurled area with one's thumb and forefinger in much the same way as one would hold a manual gouge.

Rear one-piece enclosure 30 functions as an enclosure for the end of flex rotor shaft 34. Rear one-piece enclosure 30 functions as a partial enclosure for rotating piece 40. One end of rear one-piece enclosure 30 is terminated in male threads for mating to the female threads of front one-piece enclosure 20. Rear one-piece enclosure 30 provides a non-slip surface for hand tightening to, or loosening from, front one-piece enclosure 20. Rear one-piece enclosure 30 provides a threaded hole whereby thumbscrew 32 can be tightened against flex rotor shaft 34 thereby securing my hand-held, reciprocating attachment to flex rotor shaft 34.

Bearing 22 provides low-friction rotative support for the coaxial shaft of rotating piece 40 and rests snuggly in position in a recess of front one-piece enclosure 20 in coaxial alignment with rotating piece 40.

Rotating piece 40, a one-piece item, provides a cam groove for the cam follower of reciprocating piece 50 whereby reciprocating motion is imparted to reciprocating piece 50 as rotating piece 40 rotates. Rotating piece 40 provides variable amounts of stroke for reciprocating piece 50, the exact amount of stroke being determined at the time of manufacture of a particular rotating piece 40. Rotating piece 40 functions as the mechanical connection to flex rotor shaft 34 in order to couple rotational drive to my hand-held, reciprocating attachment. Rotating piece 40 connects to flex rotor shaft 34 by way of coaxially aligned female-to-male mating threads. Rotating piece 40 connects to bearing 22 by way of a shaft coaxially aligned with center of bearing 22.

Reciprocating piece 50, a one-piece item, slidably mounts in front one-piece enclosure 20 and provides a cam follower on one end for the cam groove of rotating piece 40 whereby the cam action results in reciprocating action of reciprocating piece 50 of a stroke length determined by the cam groove offset. The other end of reciprocating piece 50 extends slightly past the small end of front one-piece enclosure 20, even at its rearmost point of travel, and provides an attachment point for a tool holder or collet so that various cutting tools may be utilized. A portion of reciprocating piece 50 on the same side as the cam follower of reciprocating piece 50 in aposition to rotating piece 40 is relieved just enough to provide clearance from the main body of rotating piece 40 and the relief is curved around a portion of the main body of rotating piece 40 so as to prevent rotation of reciprocating piece 50 which, in turn, prevents disengagement of the cam follower on reciprocating piece 50 from the cam groove on rotating piece 40.

DESCRIPTION AND OPERATION OF ALTERNATIVE EMBODIMENTS

Figure 13A:
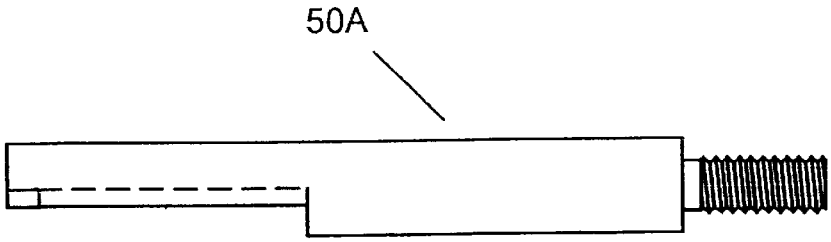
FIG. 13A shows a reciprocating piece terminated with male threads
Figure 13B:
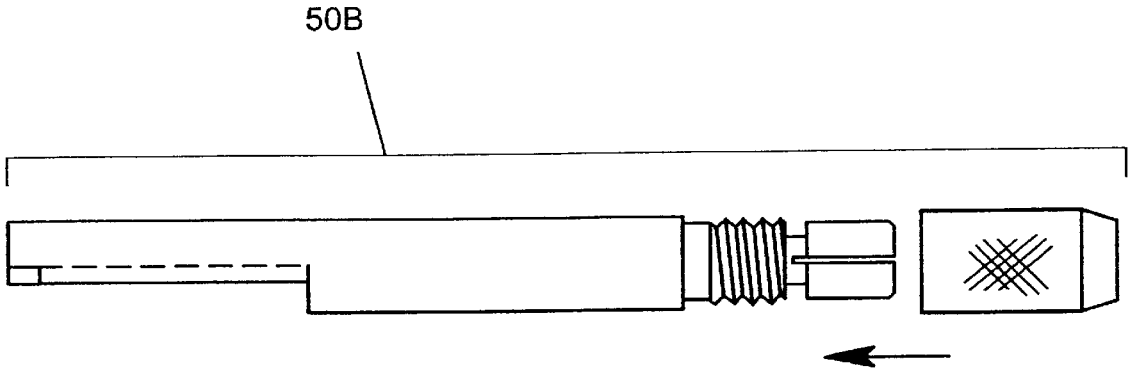
FIG. 13B shows a reciprocating piece terminated with an integrated tool holder
Figure 13C:
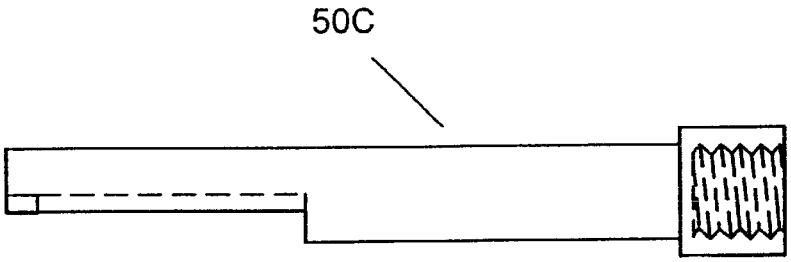
FIG. 13C shows a reciprocating piece terminated with larger female threads
Figures 14A, 14B:
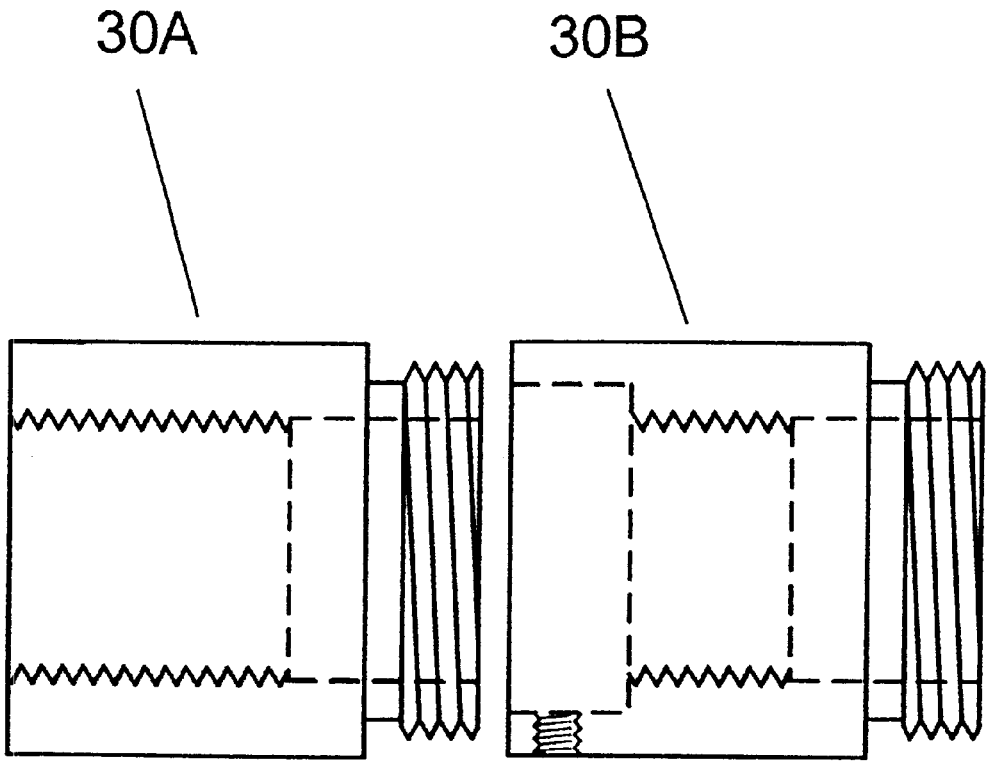
FIG. 14A shows one alternative example of rear one-piece enclosure for direct attachment to power rotary tool
FIG. 14B shows one alternative example of rear one-piece enclosure for direct attachment to a different style of power rotary tool
Figure 15:
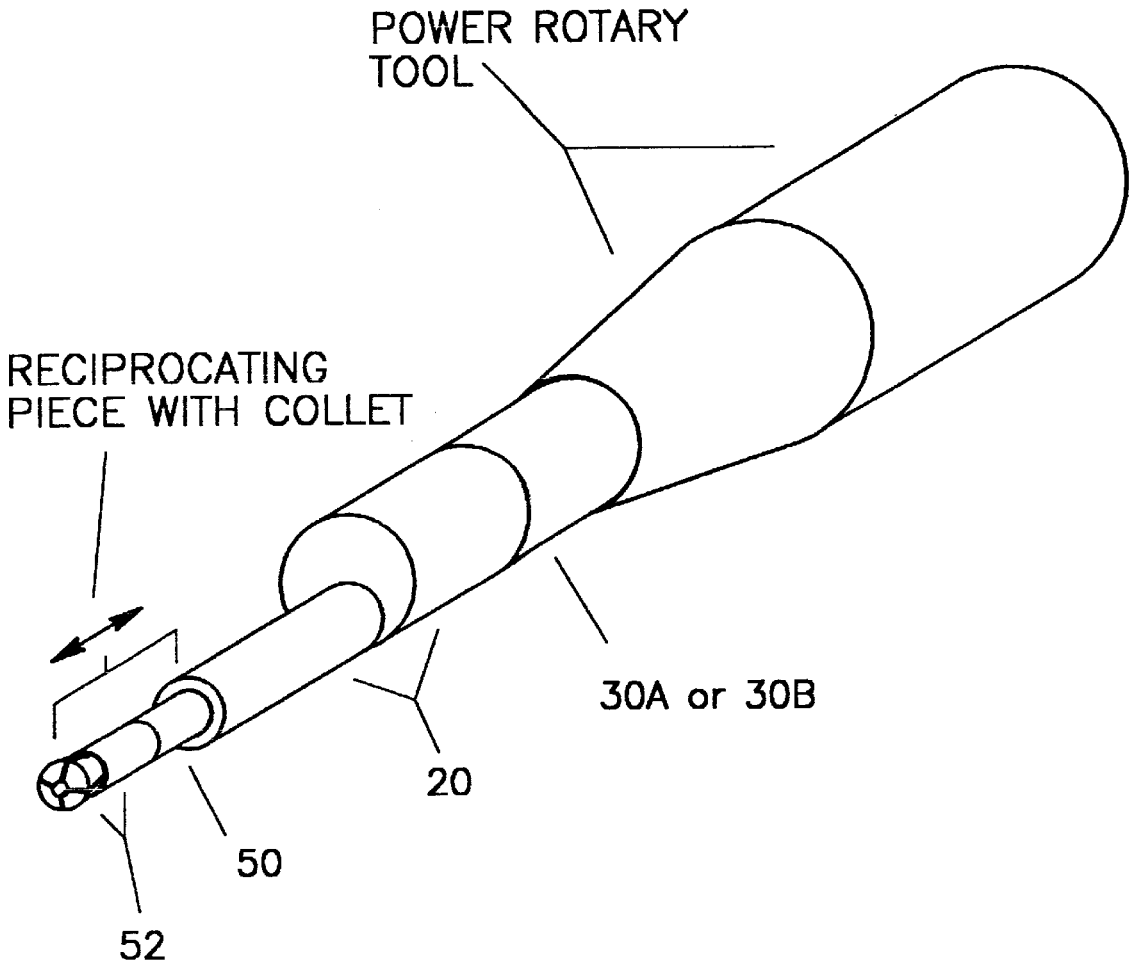
FIG. 15 shows alternative perspective view with power rotary tool and no flex rotor shaft
Figures 16A, 16B:
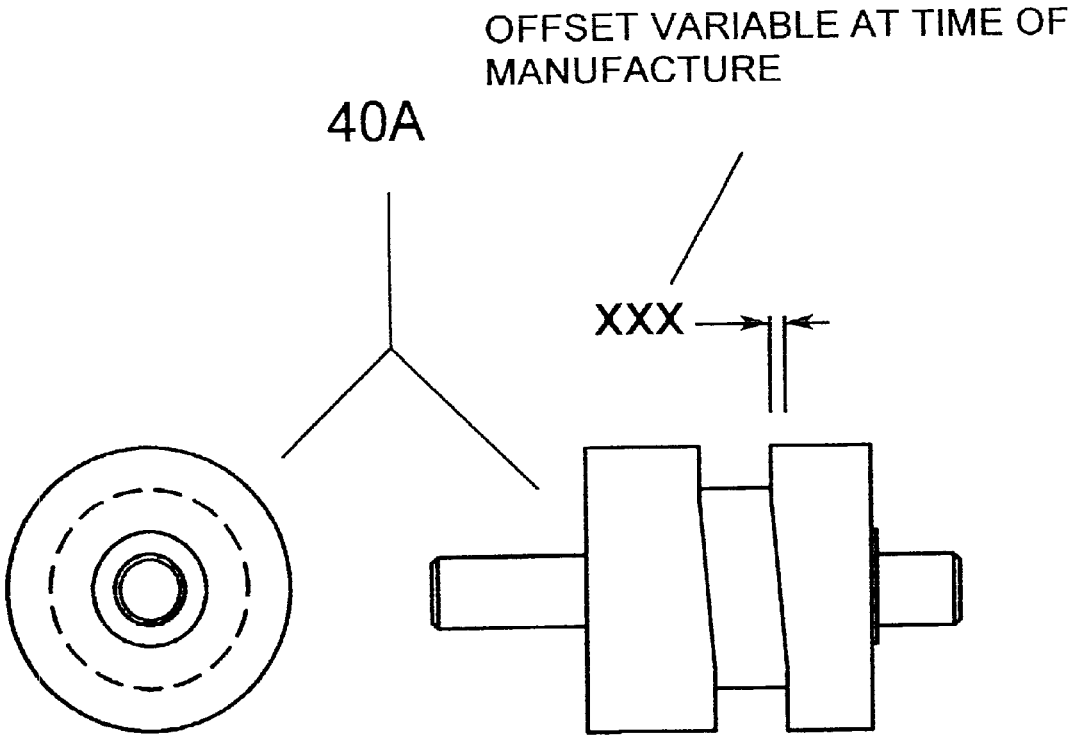
FIG. 16 shows one alternative example of rotor with shaft for mounting in chucks and collets

There are numerous possibilities with regard to a method of manufacture, size, shape, material, and application. Methods of manufacture can include, but are not limited to, machining, molding, casting, molding with secondary machining, casting with secondary machining, and metal injection molding. Methods of attaching various pieces to each other can vary to accommodate various assembly techniques and methods of attachment to external drive mechanisms can be varied. For example, a rotating piece can be made with a coaxial shaft, reference numeral 40A, FIG. 16, of various diameters and lengths in lieu of female threads for installing into various commercially available chucks/collets, selected from the group consisting of chucks, collets, and adapters, found on various rotor tools. The female threads of the rotor can be specified in different sizes and depth for installing onto various rotor tools. Also, the method of attachment of the cutting tools to the reciprocating piece can be varied to allow for reciprocation of a cutting tool in the vertical plane, the horizontal plane, or anything in between. Also, the method of attachment of the cutting tools to the reciprocating piece can be varied by, including but not limited to, replacing the female threads of the preferred embodiment, illustrated in FIG. 6A, reference numeral 50, with larger female threads to accept larger collets, illustrated in FIG. 13C, reference numeral 50C, or with various sizes of male threads, illustrated in FIG. 13A, reference numeral 50A, or various sizes of an integral one-piece split collet with a separate tightening band, illustrated in FIG. 13B, reference numeral 50B. Sizes of various pieces, and internal dimensions thereof, can be varied to adapt to various external rotary drive mechanisms and to various sizes of cutting blades, carving blades and gouges, saw blades, chisels, files, and sanding devices for various applications. For example, a front one-piece enclosure and rear one-piece enclosure can be re-sized externally and internally for adapting to larger or smaller diameter external drive mechanisms. Referring to FIG. 14A and FIG. 15, an alternative of the rear one-piece enclosure, reference numeral 30A, can be adapted for direct attachment to a power rotary tool instead of to the flex rotor shaft of a power rotary tool. Referring to FIG. 14B and FIG. 15, another alternative of the rear one-piece enclosure, reference numeral 30B, can be adapted for direct attachment to a different style of power rotary tool, FIG. 14B and FIG. 15. Shapes can be altered to satisfy various mechanical or ergonomic/human engineering needs, such as, but not limited to, shape of form-fitting hand grip for right-handed and/or left-handed users. Additionally, a form-fitting hand grip, or any desired outside shape, can be in the form of a molded shroud around the tool. Additionally, an outside shroud can be of foam-like material. Materials for any of the pieces can include, but are not limited to, various metal alloys, various long-wear and/or self-lubricating alloys or engineering plastics or resins, ceramics, composites, or combinations thereof. Applications can include, but are not limited to, odd jobs, home repair jobs, arts and crafts, hobby projects, sculpture, electronic printed-circuit board rework, picture frame mat cutting, and professional model building.

CONCLUSION, RAMIFICATIONS, AND SCOPE OF INVENTION

Accordingly, the reader will see that the high-speed, hand-held reciprocating assembly for cutting, carving, sawing, chiseling, filing, sanding, and engraving of the subject invention provides a very versatile, very compact, easy-to-use, reliable, economical device that can be used to perform various types of fine detail work on numerous types of materials with numerous types of cutting tools. Furthermore, my hand-held, reciprocating attachment has the additional advantages in that

- it serves as an attachment, in its various configurations, for existing flex rotor shaft extensions of power rotary tools and for direct attachment to existing power rotary tools without the flex rotor shaft extensions thereby making it more economical for hobbyists and professional consumers to expand the capabilities of their workshop while being able to avoid the extra cost of a built-in motor and its associated parts;
- its design accommodates all types of small cutting tools requiring reciprocating action instead of being dedicated to just one or two types of cutting tools thereby making it much more versatile;
- its design accommodates the use of a hardened point tool for engraving thereby eliminating the need to own a separate, motorized engraving tool;
- it allows the consumer the option of using his or her existing compatible tool holders/collets and various cutting tools thereby making it even more economical and attractive for the consumer;
- it comprises a minimum number of pieces thereby making it more economical and reliable;
- its design eliminates the need for springs, gears, pins, clips, clamps, nuts, bolts, washers, and other such wear dependent pieces thereby also making it more reliable;
- its simplicity allows for quick and easy assembly and attachment to the rotary power source without the need for any assembly tools;
- its high-speed capability allows for material cutting and/or material removal in a minimum amount of time and with less force applied by the user thereby minimizing operator fatigue;
- its reciprocating cutting tool, being on the assembly's extremity with no interfering pieces, allows deep, perpendicular cuts, and cuts at any angle, in cramped spaces that exceed the radius-depth limitations of rotary cutting tools;
- its variable-speed, short-stroke reciprocating action allows for use on delicate work pieces by eliminating the potential loss of control of a spinning cutting tool, which is prevalent in rotating cutters, grinders, and sanders, thereby making the operation safer for both the user and the work piece;
- its reciprocating stroke length is variable by easily changing rotating pieces; and
- its short-stroke reciprocating action allows a rotary tool to be adapted for the novel use of miniature chisels on fine, delicate work pieces such as, for only one example, inlay operations.

While my above description contains many specificities, these should not be construed as limitations on the scope of my hand-held reciprocating attachment, but rather as an exemplification of one preferred embodiment thereof. Many other variations are possible. For example, the front and rear one-piece enclosure can be made smaller or larger with different sized openings to accommodate various rotary drive tools and/or their flex rotary shaft extensions and the individual pieces of my hand-held reciprocating attachment can be made in different sizes; the housings can be of different shapes or contours to match different rotary tool requirements and/or for reasons of aesthetics and ergonomics; the pieces can be made in different colors and/or types of surface finishes; the rotating piece with integral cam can be made smaller or larger and the cam groove can be varied to create various stroke lengths for the reciprocating cam follower; the rotating piece can be made with a shaft of various sizes, in place of the female threads, for mounting in chucks and collets; the individual pieces of my hand-held reciprocating attachment can be made of various materials; the reciprocating piece can have its exposed end altered to accept various sizes and styles of tool holders/collets and the tool holders/collets can be various shapes and sizes to accept various tool attachments; the various pieces of my hand-held reciprocating attachment can be made using various manufacturing methods, including but not limited to, machining, casting, molding, casting with secondary machining, molding with secondary machining, and metal injection molding; the thumbscrew, used for securing my hand-held reciprocating attachment to the externally supplied power rotary source, can be replaced with a plurality of thumbscrews, or set screws, or a twist-lock mechanism, or various other methods of securing my hand-held reciprocating attachment to the power rotary source, etc.

Thus the scope of my hand-held, reciprocating attachment should be determined by the appended claims and their legal equivalents, rather than by examples given.

I claim:

1. A powered reciprocating hand-held assembly for expanding the capabilities of power rotary tools with flex rotor shafts comprising a two-piece enclosure wherein a front one-piece enclosure serves to slidably enclose a reciprocating piece having a cylindrical shaft protrusion portion and a concave void protrusion portion, wherein an end of said cylindrical shaft protrusion portion receives a tool holder, wherein an end of said concave void protrusion portion having an integral cam follower, said front one-piece enclosure further serves to captivate a cylindrical single row radial bearing and serves to enclose a rotating piece and serves to mate with a rear one-piece enclosure; said cam follower connecting to said rotating piece, said cylindrical single row radial bearing being located juxtaposed to said concave void protrusion portion; wherein a rear one-piece enclosure encloses a means for converting rotary motion to reciprocal motion and serves to enclose a portion of the rotating end of a hand piece of a flex rotor shaft and serves to be firmly affixed to a flex rotor shaft and serves to be installed and removed from a flex rotor shaft and serves to mate with a front one-piece enclosure, a means for securing one of a plurality of reciprocative cutting tools to said assembly, and a means for securing said assembly to said flex rotor shaft of a power rotary tool wherein the previously unavailable expanded capabilities include reciprocative cutting, carving, sawing, chiseling, filing, sanding, and engraving of wood, wood-based products, metals, and plastics and engineering resins whereby a knowledgeable user can perform more detailed work on delicate work pieces than is possible from using a power rotary tool having only rotary cutting attachments.

2. The means of converting rotary motion to reciprocal motion of claim 1 comprising a rotary piece, a reciprocating piece, and a cylindrical single row radial bearing.

3. The rotary piece of claim 2 wherein one end of said rotating piece is rotatively attached to, and supported by, said flex rotor shaft of a power rotary tool and wherein the other end of said rotating piece is rotatively disposed in, and supported by, a cylindrical single row radial bearing and wherein the body of said rotating piece is of one-piece construction and cylindrical in shape and wherein said body has an end, hereafter referred to as the first end, and wherein said body has another end, hereafter referred to as the second end, and wherein said body has a length, hereafter referred to as the first length, and wherein said body has a major diameter, hereafter referred to as the first diameter, and wherein said body has a minor diameter, hereafter referred to as the second diameter, and wherein said first diameter extends longitudinally from said first end toward said second end for a length, hereafter referred to as the second length, and wherein said second length has an end point, and wherein said second length is bounded by said first end and said end point, and wherein said second diameter extends longitudinally from said second end toward said first end for a length, hereafter referred to as the third length, and wherein said third length is bounded by said second end and said end point such that said second length plus said third length equals said first length, and wherein said first diameter transitions in a step-change manner to said second diameter at said end point, and wherein said body includes an integral, sinusoidal cam groove extending around the longitudinal axis of said body and axially centered about the longitudinal axis of said body, and wherein said cam groove is positioned within the confines of said second length, and wherein the placement of said cam groove neither includes the plane of said first end nor the plane of said end point, and wherein said cam groove has a width and depth sufficient to allow a cam follower to be disposed within said cam groove, and wherein said first end of said body is terminated with female threads concentric with the longitudinal axis of said body and wherein said female threads are sized to mate with the corresponding male threads on the end of said flex rotor shaft and wherein said second diameter and said third length are sized to mate coaxially with said cylindrical single row radial bearing and wherein said rotating piece is rotatively supported between said flex rotor shaft and said cylindrical single row radial bearing and wherein said cam groove is such that it allows the cam follower of the reciprocating piece to be disposed in said cam groove.

4. The reciprocating piece of claim 2 wherein said reciprocating piece is slidably mounted in a front enclosure and wherein one end of said reciprocating piece has female threads to accept a tool holder and wherein the other end of said reciprocating piece has a cam follower that is disposed in and captured by said cam groove of said rotating piece and wherein its body is of one-piece construction and cylindrical in shape and wherein said body has an end, hereafter referred to as first end, and wherein said body has another end, hereafter referred to as second end, and wherein said body has a major diameter, hereafter referred to as first diameter, and wherein said first diameter is sized to allow said reciprocating piece to slidably fit inside a front enclosure, and wherein said body has a total length between said first end and said second end, hereafter referred to as first length, and wherein said first diameter of said body extends with a constant circular cross section between said first end and an endpoint for a length which is less than said first length, hereafter referred to as second length, and wherein said body further extends between said endpoint of said second length and said second end, hereafter referred to as third length, and wherein said body has a bore with a diameter less than said first diameter, hereafter referred to as a second diameter, and wherein said bore is parallel and coaxial with the longitudinal axis of said body, and wherein said bore extends from said first end for a length which is less than said second length, hereafter referred to as fourth length, and wherein said fourth length is as long as practical, short of said second length, to minimize body mass, and wherein said bore is tapped for female threads from said first end for a length, hereafter referred to as fifth length, and wherein said fifth length is less than said fourth length, and wherein said female threads and said fifth length are sized to properly accept the male threads of a tool holder, and wherein said body has a concave void bounded on one end by the endpoint of said second length and extending towards said second end for a length to an endpoint, hereafter referred to as sixth length, and wherein said sixth length is less than said third length, and wherein said concave void has a constant cross section, and wherein said concave void has a radius slightly larger than the major radius of said rotating piece, hereafter referred to as first radius, and wherein said concave void is symmetrical about a cross sectional centerline of said body, and wherein said concave void extends into said body and slightly past the longitudinal axis of said body, and wherein the longitudinal axis of said concave void is parallel to the longitudinal axis of said body, and wherein said body has in integral cam follower, and wherein said cam follower has a longitudinal length, hereafter referred to as seventh length, which is bounded on one end by the endpoint of said sixth length which coincides with the end of said concave void, and on the other end by said second end, and wherein for further clarity the sum of said sixth length and said seventh length equals said third length, and wherein said seventh length and the general cross section of said cam follower and the vertical height of said cam follower, of which the vertical height is bounded by a point common to the longitudinal axis of said reciprocating piece and said second end and the extremity of said cam follower, allows said cam follower to be disposed in the cam groove of said rotating piece, and wherein for further clarity said first diameter of said rotating piece is disposed in the concave void of said body of said reciprocating piece such that a minimum clearance exists between the two curved surfaces to allow freedom of rotation of said rotating piece and to allow freedom of reciprocation of said reciprocating piece, and wherein any tendency for rotation of said reciprocating piece is prevented by way of the concave surface of said reciprocating piece in concert with the surface of first diameter of said reciprocating piece.

5. The cylindrical single row radial bearing of claim 2 wherein said cylindrical single row radial bearing rotatably supports said coaxial shaft of said rotating piece and wherein said cylindrical single row radial bearing accommodates rotational motion of said rotating piece in relation to said reciprocating piece and wherein said cylindrical single row radial bearing is capable of tolerating the desired rotational speed and wherein said cylindrical single row radial bearing has a properly-sized outside diameter to fit securely inside a void of said enclosure at a predetermined location and wherein said cylindrical single row radial bearing is axially-aligned with longitudinal axis of said rotating piece and wherein said cylindrical single row radial bearing has a properly-sized inside diameter to accept said coaxial shaft of said rotating piece with a minimum amount of clearance between the two mating surfaces consistent with good design practices and wherein said minimum clearance allows easy insertion and removal of said coaxial shaft of said rotating piece from center of said cylindrical single row radial bearing.

6. The two-piece enclosure of claim 1 comprising a front one-piece enclosure and a rear one-piece enclosure.

7. The front one-piece enclosure of claim 6 wherein said front one-piece enclosure serves to slidably enclose said reciprocating piece and wherein said front one-piece enclosure serves to captivate said cylindrical single row radial bearing and wherein said front one-piece enclosure serves to enclose said rotating piece and wherein said front one-piece enclosure mates with said rear one-piece enclosure and wherein said front one-piece enclosure is of one-piece construction and wherein one end, which will be referred to as the first end, is of adequate outside diameter and inside diameter to enclose said rotating piece and said cylindrical single row radial bearing and said reciprocating piece when they are positioned in proper relation to each other and wherein the other end of said front one-piece enclosure, which will be referred to as the second end, is of a smaller outside and inside diameter to slidably enclose said reciprocating piece and wherein a segment inboard of the second end is surrounded with a slip-resistant finish whereby a user's fingers can achieve a reliable grip for holding during use and wherein the longitudinal axis centered within, and perpendicular to, said first end, hereafter referred to as first longitudinal axis, and the longitudinal axis centered within, and perpendicular to, said second end, hereafter referred to as second longitudinal axis, are not coaxial and wherein said first longitudinal axis and said second longitudinal axis are parallel and wherein longitudinal axis of said cylindrical single row radial bearing and longitudinal axis of said rotating piece are coaxial with said first longitudinal axis and wherein longitudinal axis of said reciprocating piece is coaxial with said second longitudinal axis and wherein said front one-piece enclosure allows said rotating piece and said cylindrical single row radial bearing to be coaxially mounted without interference to said rotating piece and wherein said front one-piece enclosure allows for a snug fit between body of said front one-piece enclosure and outside diameter of said cylindrical single row radial bearing and wherein said front one-piece enclosure allows for slidably mounting of reciprocating piece with a distance between said first longitudinal axis and said second longitudinal axis such that said reciprocating piece is mounted in aposition to said rotating piece such that cam follower of said reciprocating piece is properly disposed inside cam groove of said rotating piece while maintaining a minimal distance between body of said rotating piece and the concave relief of said reciprocating piece and wherein said first end of said front one-piece enclosure is terminated in female threads for mating with said rear one-piece enclosure and wherein said second end of said first one-piece enclosure is positioned along the length of said front one-piece enclosure such that threaded end out of said reciprocating piece is always exposed while reciprocating.

8. The rear one-piece enclosure of claim 6 wherein said rear one-piece enclosure is made to enclose a portion of the rotating end of the hand piece of said flex rotor shaft and wherein said rear one-piece enclosure can be firmly affixed to said flex rotor shaft and wherein said rear one-piece enclosure can be installed and removed from said flex rotor shaft and wherein said rear one-piece enclosure mates with said first one-piece enclosure and wherein position of said rear one-piece enclosure can be adjusted longitudinally along the hand piece of said flex rotor shaft before firmly affixing such that said reciprocating piece is allowed to reciprocate along its longitudinal axis through its full stroke without interference from said front and rear one-piece enclosures and wherein said rear one-piece enclosure is of one-piece construction and wherein said rear one-piece enclosure has an outside diameter approximately equal to the larger-diameter end of said front one-piece enclosure and wherein said rear one-piece enclosure is terminated on one end, which is to be referred to as the first end, with male threads compatible with female threads of said front one-piece enclosure for mating with said front one-piece enclosure and wherein a segment inboard of the threaded section of the first end is surrounded with a slip-resistant finish whereby a user's fingers can achieve a reliable grip for screwing and unscrewing said rear one-piece enclosure to said front one-piece enclosure and wherein said inside diameter of the first end of said rear one-piece enclosure allows for all around clearance of said rotating piece and wherein the inside diameter of the other end of said rear one-piece enclosure, which is to be referred to as the second end, is smaller in diameter than the inside diameter of the first end of said rear one-piece enclosure and slightly larger in diameter than the outside diameter of said flex rotor shaft whereby said rear one-piece enclosure may be slipped over said flex rotor shaft and wherein a means is provided near the second end for securing said rear one-piece enclosure to said flex rotor shaft and wherein said means for securing is a perpendicular, threaded through-hole in the side of said rear one-piece enclosure for accepting a thumbscrew of the proper size.

9. The rear one-piece enclosure of claim 1 wherein said rear one-piece enclosure is made to enclose a portion of the rotating end of said power rotary tool and wherein said rear one-piece enclosure can be firmly affixed to said power rotary tool and wherein said rear one-piece enclosure can be installed and removed from said power rotary tool and wherein said rear one-piece enclosure mates with said front one-piece enclosure and wherein the longitudinal fixed dimensions of said rear one-piece enclosure are such that, when said rear one-piece enclosure is properly mated with said power rotary tool, said reciprocating piece is allowed to reciprocate along its longitudinal axis throughout its full stroke without interference from said front and rear one-piece enclosures and wherein said rear one-piece enclosure is of one-piece construction and wherein said rear one-piece enclosure has an outside diameter approximately equal to the larger-diameter end of said front one-piece enclosure and wherein said rear one-piece enclosure is terminated on one end, which is to be referred to as the first end, with male threads compatible with female threads of said front one-piece enclosure for mating with said front one-piece enclosure and wherein a segment inboard of the threaded section of the first end is surrounded with a slip-resistant finish whereby a user's fingers can achieve a reliable grip for screwing and unscrewing said rear one-piece enclosure to said front one-piece enclosure and wherein said inside diameter of the first end of said rear one-piece enclosure allows for all around clearance of said rotating piece and wherein the inside diameter of the other end of said rear one-piece enclosure, which is to be referred to as the second end, is larger in diameter than the inside diameter of the first end of said rear one-piece enclosure and slightly larger in diameter than the outside diameter of said power rotary tool whereby said rear one-piece enclosure may be slipped over the end of said power rotary tool and wherein a means is provided near the second end for securing said rear one-piece enclosure to said power rotary tool and wherein said means for securing is said second end terminated with recessed, female threads compatible with male threads of said power rotary tool for mating with said power rotary tool.

10. The means for securing one of a plurality of cutting tools to said assembly of claim 1 comprising the female-threaded end of body of said reciprocating piece and a tool holder with a male-threaded end that allows mating with the aforementioned female threads.

11. The female-threaded end of body of said reciprocating piece of claim 10 wherein said female-threaded end includes a female-threaded hole centered about the longitudinal axis of said reciprocating piece whereby said female-threaded hole is sized to properly mate with male threads of said tool holder.

12. The tool holder of claim 10 wherein tool holder is terminated on one end with male-threads that allows mating with female threads of said female-threaded end of reciprocating piece and wherein the other end of said tool holder is slotted and has a tightening mechanism to facilitate firm capturing of tools and wherein tool holder is selected from the group consisting of chucks, collets, and adapters.

* * * * *